US005251112A

United States Patent [19]

Chen

[11] Patent Number: 5,251,112

[45] Date of Patent: Oct. 5, 1993

[54] FLASHING AND MUSICAL DEVICE FOR A WRITING IMPLEMENT

[76] Inventor: Ming H. Chen, P.O. Box 82-144, Taipei, Taiwan

[21] Appl. No.: 950,026

[22] Filed: Sep. 24, 1992

[51] Int. Cl.[5] ..... B43K 29/10

[52] U.S. Cl. ..... 362/118; 362/202; 362/800; 401/195

[58] Field of Search ..... 362/118, 800, 202; 401/195

[56] References Cited

U.S. PATENT DOCUMENTS

| | | | |
|---|---|---|---|
| 4,206,495 | 6/1980 | McCaslin | 362/800 |
| 5,079,679 | 1/1992 | Chin-Fa | 362/202 |
| 5,131,775 | 7/1992 | Chen | 362/118 |

*Primary Examiner*—Carroll B. Dority
*Attorney, Agent, or Firm*—Alfred Lei

[57] ABSTRACT

This invention relates to a flashing and musical device for a writing implement and in particular to one including an upper cylindrical member formed with a recess having internal threads at a lower end. A speaker mounted within the recess of the upper cylindrical member. A controlling board electrically connected with the speaker and mounted within the recess of the upper cylindrical member. A trigger mounted under the controlling board and having two holes each engaged with a conical conducting member and a movable member disposed within the trigger. A light-emitting diode mounted on the upper cylindrical member and electrically connected with the controlling board. An upper conducting plate mounted under the trigger. A battery disposed under the upper conducting plate. A lower conducting plate arranged under the battery. A lower cylindrical member with external threads and a recess on a top being engaged with the upper cylindrical member. A knob fitted into the recess of the lower cylindrical member and located under the lower conducting plate, whereby the device will send out flashing light and produce music when rotated.

1 Claim, 5 Drawing Sheets

FLASHING AND MUSICAL DEVICE FOR A WRITING IMPLEMENT

BACKGROUND OF THE INVENTION

It is found that the prior art ball-point writing implement is discarded when the reservoir tube therein is used up thereby causing expenditure and producing a lot of rubbish.

Hence, it is an object of the present invention to provide a flashing and musical device for a writing implement which may interest the user to replace a new reservoir tube when the reservoir tube in the writing implement is used up.

SUMMARY OF THE INVENTION

This invention relates to a flashing and musical device for a writing implement.

It is the primary object of the present invention to provide a flashing and musical device for a writing implement which may send out flashing light when rotated.

It is another object of the present invention to provide a flashing and musical device for a writing implement which may produce music when rotated.

It is still another object of the present invention to provide a flashing and musical device for a writing implement which may increase additional value of the writing implement.

It is still another object of the present invention to provide a flashing and musical device for a writing implement which may make the writing implement interesting.

It is a further object of the present invention to provide a flashing and musical device for a writing implement which is facile to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
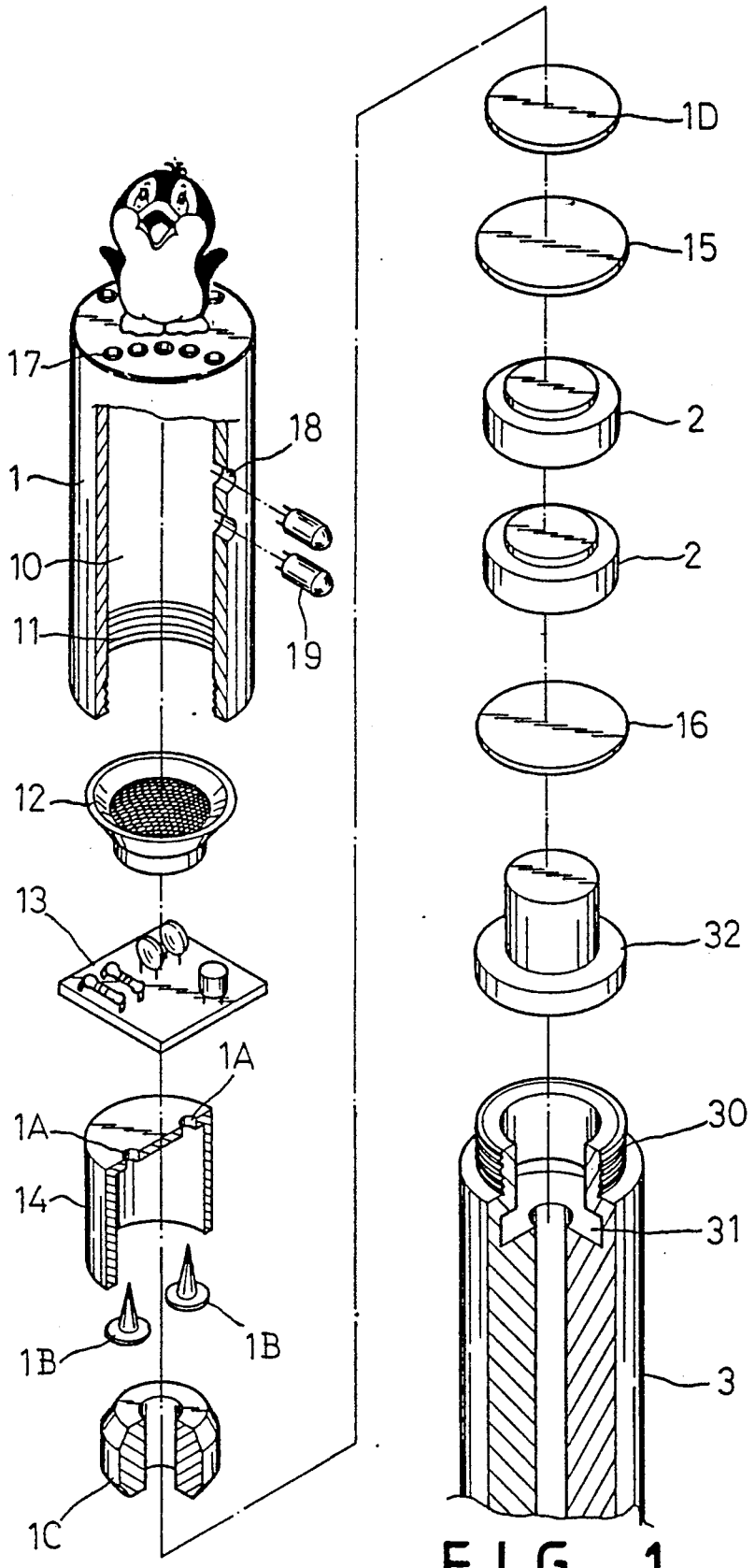
FIG. 1 is an exploded view of the present invention.
Figure 2:
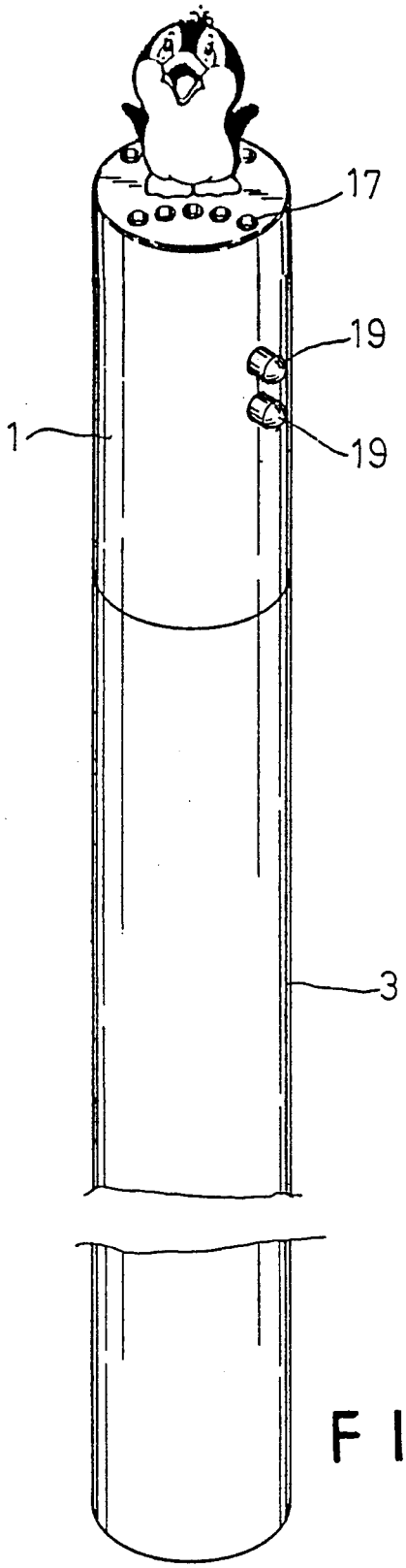
FIG. 2 is a perspective view of the present invention.
Figure 3:
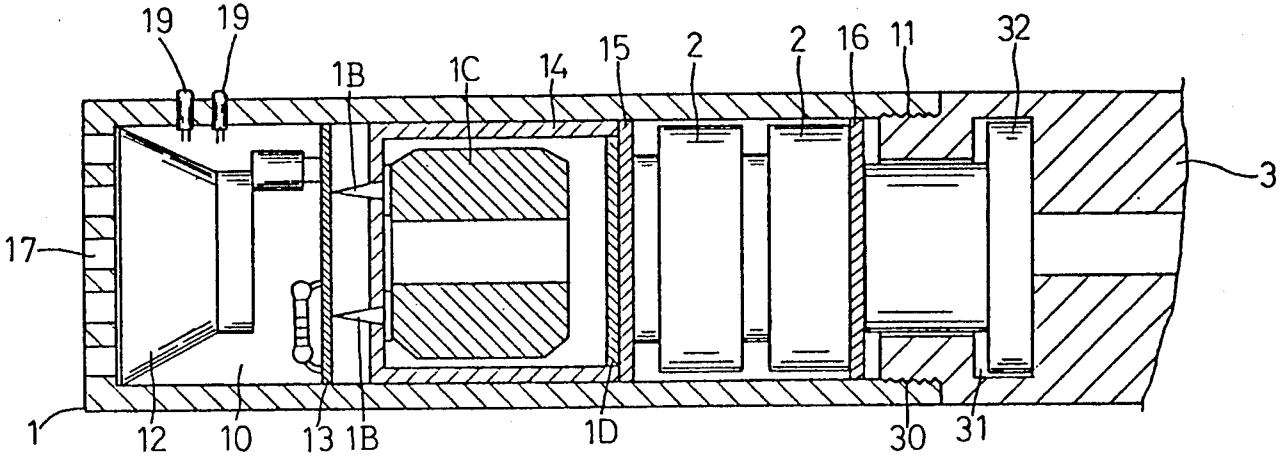
FIGS. 3 and 3A are sectional views of the present invention.
Figure 3A:
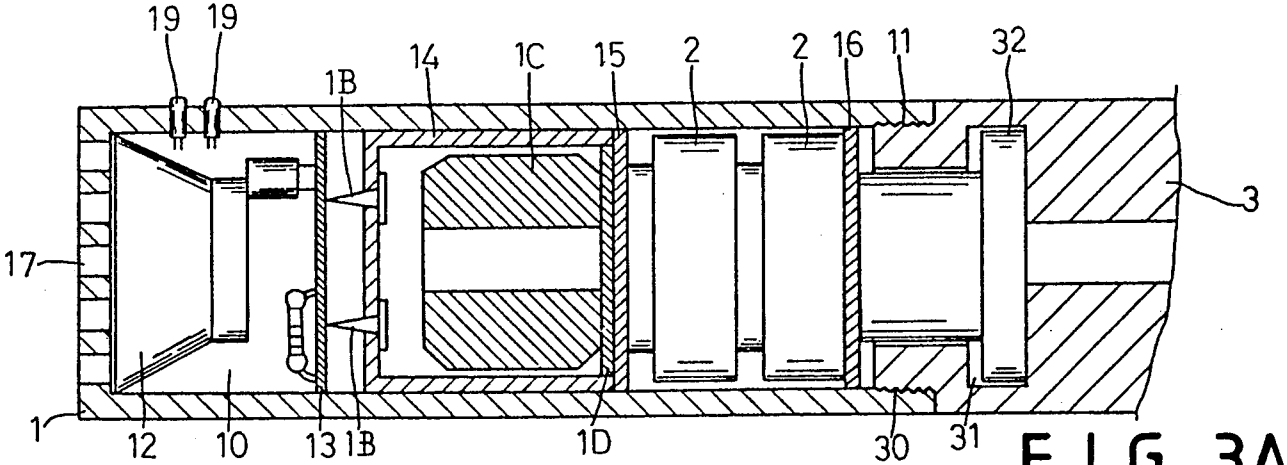
Figure 4:
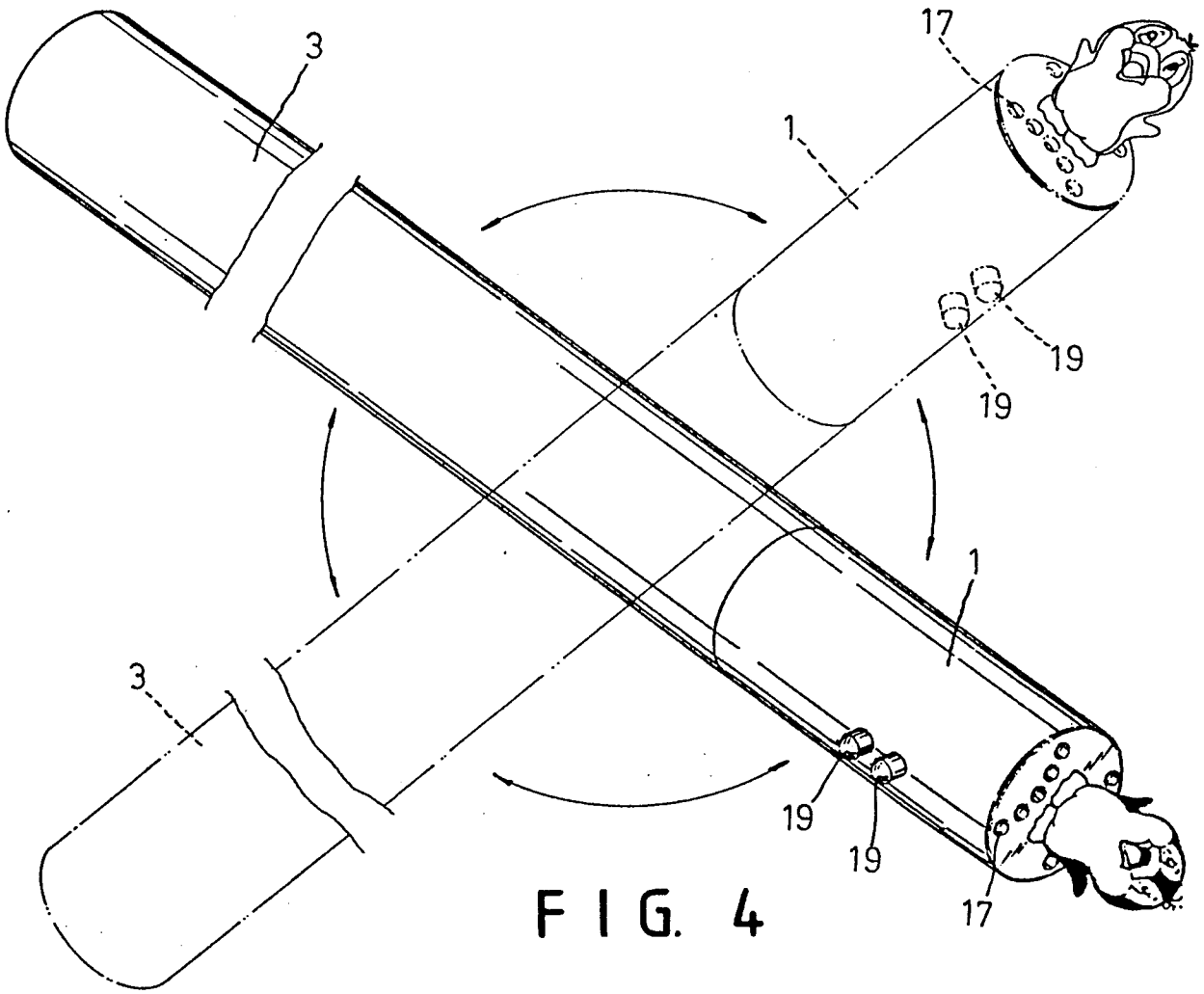
FIG. 4 shows the principle of the present invention.
Figure 5:
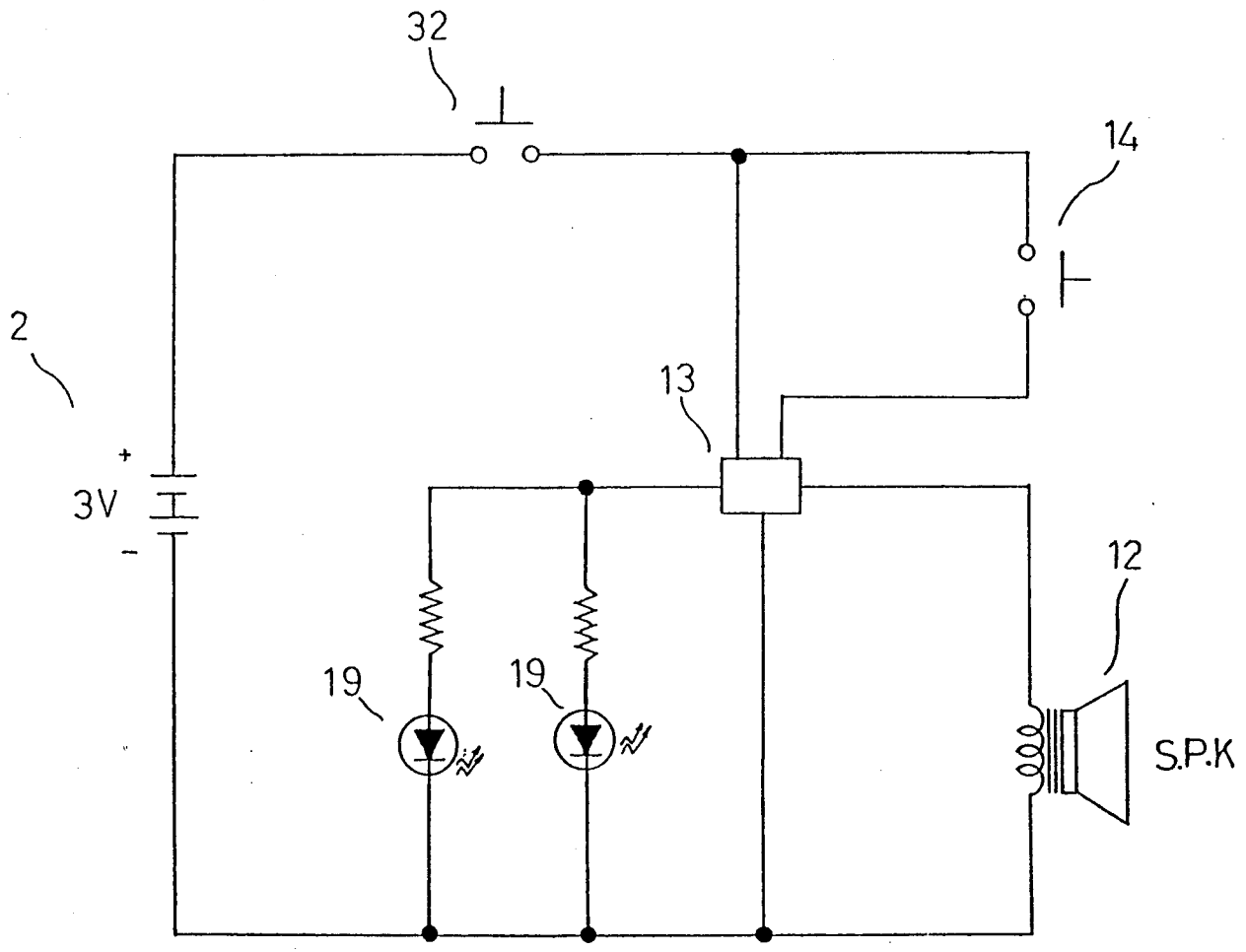
FIG. 5 shows an electrical circuit of the present invention.

With reference to the drawings and in particular to FIG. 1 thereof, the flashing and musical device for a writing implement according to the present invention is adapted to the upper part of the writing implement and comprises an upper cylindrical member 1 formed with a recess 10 having internal threads 11 at the lower end. Within the recess 10 there are mounted a speaker 12, a controlling board 13 electrically connected with the speaker 12, a trigger 14, an upper conducting plate 15, two batteries 2, and a lower conducting plate 16. The trigger 14 is formed with two holes 1A each engaged with a conical conducting member 1B. A movable member 1C is disposed in the trigger 14 and kept therein by a cover 1D. Further, the upper cylindrical member 1 is provided with a plurality of perforations 17 on the top and two openings 18 on the vertical side.

A lower cylindrical member 3 with external threads 30 and a recess 31 on the top is engaged with the upper cylindrical member 1. In addition, a knob 32 is fitted into the recess 31 of the lower cylindrical member 3 and located under a lower conducting plate 16. In assembly, first fit the conical conducting members 1B with the holes 1A of the trigger 14. Then dispose the movable member 1C into the trigger 14 and keep the movable member 1C therein by the cover 1D. Thereafter, mount the speaker 12, the controlling board 13, the trigger 14, the upper conducting plate 15, the battery 2 and the lower conducting plate 16 into the recess 10 of the upper cylindrical member 1 in sequence. Afterwards, fit two light-emitting diodes 19 electrically connected with the controlling board 13 into the openings 18 of the upper cylindrical member 1. Then, engage the knob 32 with the recess 31 of the lower cylindrical member 3. Finally, connect the upper cylindrical member 1 with the lower cylindrical member 3 so that the knob 32 urges the lower conducting plate 16 against the batteries 2 and the upper conducting plate 15.

As shown in FIGS. 2 through 5, when the present invention is rotated, the movable member 1C will be moved in the trigger 14 thereby contacting the conical conducting members 1B intermittently and therefore sending a triggering signal to the controlling board 13. Hence, the speaker 12 will be actuated to produce music. In the meantime, the light-emitting diodes 19 will be controlled by the controlling board 13 to flash. As a result, the present invention will flash and produce music when rotated.

However, when desired to prevent the present invention from producing music and flashing inadvertently, simply loosen the connection between the upper cylindrical member 1 from the lower cylindrical member 3 so that the knob 32 will no longer urge against the lower conducting plate 16 thus separating the batteries 2 for the upper conducting plate 15.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A flashing and musical device for a writing implement comprising:

an upper cylindrical member formed with a recess having internal threads at a lower end;

a speaker mounted within the recess of said upper cylindrical member;

a controlling board electrically connected with said speaker and mounted within the recess of said upper cylindrical member;

a trigger mounted under said controlling board and having two holes each engaged with a conical conducting member and a movable member disposed within said trigger;

a light-emitting diode mounted on the upper cylindrical member and electrically connected with said controlling board;

an upper conducting plate mounted under said trigger;

a battery disposed under said upper conducting plate;

a lower conducting plate arranged under said battery;

a lower cylindrical member with external threads and a recess on a top being engaged with said upper cylindrical member;

a knob fitted into the recess of said lower cylindrical member and located under said lower conducting plate.

* * * * *